US005791710A

United States Patent [19]

Marler

[11] Patent Number: 5,791,710

[45] Date of Patent: Aug. 11, 1998

+

[54] APPARATUS FOR LATCHING AND UNLATCHING A LOAD SUSPENDED FROM A LIFTING LINE

[76] Inventor: Joseph E. Marler, P.O. Box 134, Livingston, La. 70754

[21] Appl. No.: 780,693

[22] Filed: Jan. 8, 1997

Related U.S. Application Data

[63] Continuation-in-part of Ser. No. 657,933, May 30, 1996.

[51] Int. Cl.[6] ..... B66C 1/16

[52] U.S. Cl. ..... 294/81.54; 294/75; 294/82.35

[58] Field of Search ..... 294/68.3, 75, 81.5, 294/81.54–81.56, 82.27, 82.35; 24/600.4–600.8, 601.6; 59/85, 86, 93

[56] References Cited

U.S. PATENT DOCUMENTS

| | | | |
|---|---|---|---|
| 994,608 | 6/1911 | Sevin et al. | 294/75 |
| 1,184,190 | 5/1916 | McIntyre | 294/75 |
| 1,198,139 | 9/1916 | Lyon . | |
| 1,419,974 | 6/1922 | McLaughlin | 294/82.35 X |
| 1,751,309 | 3/1930 | De Mone | 294/82.35 X |
| 1,908,146 | 5/1933 | Helton | 294/82.35 X |
| 2,232,997 | 2/1941 | Caldwell | 294/82.35 X |
| 2,293,653 | 8/1942 | Katz . | |
| 2,673,116 | 3/1954 | Baird | 294/75 |
| 3,138,266 | 6/1964 | Fahey et al. | 294/75 X |
| 3,462,945 | 8/1969 | Barber | 294/82.35 X |
| 3,895,836 | 7/1975 | Barnes | 294/82.35 |
| 4,098,532 | 7/1978 | Phillips | 294/75 |
| 4,148,514 | 4/1979 | McCullough . | |

FOREIGN PATENT DOCUMENTS

| | | | |
|---|---|---|---|
| 682440 | 8/1979 | U.S.S.R. | 294/82.35 |
| 703469 | 12/1979 | U.S.S.R. | 294/82.35 |
| 1346562 | 10/1987 | U.S.S.R. | 294/82.35 |

*Primary Examiner*—Johnny D. Cherry
*Attorney, Agent, or Firm*—Domingue, Delaune & Waddell

[57] ABSTRACT

An apparatus for releasing an attached load, with the load being attached with a sling is described. Generally, the apparatus comprises a plate having an underside face, and a latch member, operatively associated with the underside face, for latching and unlatching the sling from the load. The apparatus may contain an activating line attached with the latch member, and activating member, operatively associated with the activating line, for activating the latch member. The apparatus may further comprise a spreader bar that is selectively attached to the plate. In the preferred embodiment, the latch member comprises a first member mounted on the plate, with the member having an opening therein, a second member mounted on the plate, with the member having an opening therein, and a third member mounted on the plate, with the member having an opening therein. A load pin is placed within the openings. A fulcrum point is provided so that the load pin may be pivoted for latching and unlatching.

11 Claims, 9 Drawing Sheets

APPARATUS FOR LATCHING AND UNLATCHING A LOAD SUSPENDED FROM A LIFTING LINE

This application is a continuation-in-part of Applicant's previously filed application bearing Ser. No. 08/657,933 filed May. 30 1996.

BACKGROUND OF THE INVENTION

This invention relates to a device used for loading and unloading of material. More particularly, but not by way of limitation, this invention relates to an apparatus used to latch and unlatch a load of material suspended from a lifting line.

In the construction, manufacture, and/or general maintenance of industrial, residential, commercial and petrochemical facilities, the operators will find it necessary to move various types of loads. This type of movement involves the lifting of equipment, structural members and very heavy cargo. Due to the weight and nature of the equipment, structural members and cargo, and its interaction with the human operators, various surety standards have been developed in order to aid in the safety of the worker. One such regulation is known as the "100% IE-OFF". Basically, this requires for tieing off the worker to a fixed point via a connecting line and a harness worn by the worker. The "100% TIE-OFF" is applicable when the worker is off the ground 6 feet or higher.

The added safety features, however, may also effect the productivity. The worker, therefore, has to stay tied off while six feet or more off the ground, 100% of the time. As the material is moved from a first position to a second position, the rigging must be rigged-up or rigged-down, depending on the sequence of the operation. Thus, the moving of material from one point to a second point is slowed. Of course, the other associated workers and machinery (crane, operator, ground crew, etc.) are in a stand-still while the connector rigs down the connection and then maneuvers to the sling which carried the load up to him.

Thus, there is a need for a device that functions as a latching and unlatching mechanism that allows the worker to safely and efficiently release the sling means after the material, equipment and/or cargo have been properly positioned. There is also a need for an apparatus that is safer and quicker from the viewpoint of the worker so that the overall worker movement about the construction site is decreased.

SUMMARY OF THE INVENTION

An apparatus for releasing an attached load, with the load being attached with a sling means for carrying loads, is described. Generally, the apparatus comprises a plate having an underside face; and latch means, operatively associated with the underside face, for latching and unlatching the sling from the load. The apparatus may contain an activating line attached with the latch means; and activating means, operatively associated with the activating line, for activating the latch means.

The apparatus may further comprise a spreader bar that is selectively attached to the plate. The sling means includes a first sling having a first end connected to a crane and a second end connected to the spreader; a second sling having a first end connected to a crane and a second end connected to the spreader; and, a third sling having a first end connected to the latch means and a second end connected to the load so that the latch means upon activation, releases the third sling.

In the preferred embodiment, the latch means comprises a first member mounted on the plate, with the member having an opening therein, a second member mounted on the plate, with the member having an opening therein, and a third member mounted on the plate, with the member having an opening therein. In this embodiment, the first member and second member form a first chamber to receive the first end of the third sling, and the second member and the third member form a second chamber. A rod is slidably disposed within said openings of the first, second and third member thereby forming the chamber area. A biasing means, disposed about the rod, for biasing the rod into a closed position and in engagement with the openings of the first, second and third members is also provided.

In the preferred embodiment, the activating means comprises an orienting plate operatively attached to the spreader bar along with a pulley member mounted on the orienting plate. In this embodiment, the activating line is operatively associated with the pulley member.

In a second embodiment herein disclosed in FIGS. 5 through 8, a latch mechanism is claimed. Generally, the latch mechanism comprises a connection plate, a latch means, and a key member adapted to the latch means for engaging the latch means in a locked position. The latch means will include: a carrier plate attached to the underside portion of the connection plate; a guide member operatively connected to the carrier plate, with the guide members having a passage member; a load pin being operatively adapted within the passage member; and, biasing means, operatively associated with the load pin, for biasing the load pin into engagement.

In one embodiment, the guide member comprises a first member being adapted to the carrier plate; a second member being adapted to the carrier plate; a third member being adapted to the carrier plate; and a fourth member being adapted to the carrier plate. The first member and the second member form a chamber for insertion of a sling member therein, and the key member is operatively associated with the first member so that the load pin locks onto the first member.

In this embodiment, the passage member comprises a first opening having a first diameter formed within the first member, a second opening having a second diameter formed within the second member, a third opening having a third diameter formed within the third member, and a fourth opening having a fourth diameter formed within the fourth member. Also, the first diameter, second diameter, third diameter, and fourth diameter are axially offset relative to each other in a descending order.

The latch mechanism will further include a guide pin operatively associated with the load pin. A first channel is formed in the third opening and formed to slidably receive the guide pin and a second channel is formed in the fourth opening and formed to slidably receive the guide pin. In the preferred embodiment, the latch mechanism provides a fulcrum point for the load pin, with the fulcrum point being formed on the third member.

The latch mechanism may further comprise a lip member formed in the second opening to engage the key member within the second opening, a first roller bearing member operatively positioned within the first channel, and a second roller bearing member operatively positioned within the second channel. The latch mechanism may also include a load pin handle being associated with the load pin and adapted to receive an activation line for activating the load pin.

A method of carrying a load with a releasing latch is also disclosed. The method includes exerting a downward force via the sling means in a closed chamber so that the load can be carried. Next, the downward force is slackened via the sling means in the closed chamber so that the load would come to rest on a foundation. Then, the load pin can be pivoted on a fulcrum point created in the guide member. The operator would then urge the load pin through the passage in a first direction so that an open chamber is created and the sling may be released from the open chamber.

The method may further comprise placing the sling means back into the opened chamber and urging the load pin through the passage in a second direction so that the closed chamber is created. Next, the load pin is pivoted on the fulcrum point so that the key means engages the guide member. The operator can then lift the load from the foundation which in turn causes a downward force to be exerted via the sling means in the closed chamber so that the load pin is locked in place and the load can be carried to the required location.

An advantage of the present invention includes making the loading and unloading of equipment, material and cargo safer. Another advantage is the safety aspect of the latch mechanism to prevent premature release. The design allows for release only when there is no load within the chamber. Also, the loading and unloading may also be done faster and more efficient. Another advantage is the device may be used with a spreader bar. Another advantage is the types of loads the device may be used with vary widely. For instance, the device may be used for positioning large beams, rafters, or joists. Alternatively, the device may be used while loading or unloading containers, vessels and tanks. The device may be used in the construction of structures and buildings, or in the petrochemical business, or in the offshore drilling of wells. This list is meant to be illustrative.

Still yet another advantage is that the invention may be used to suit a varying capacity. Yet another advantage is that an additional safety latch with a release cord can be added for added surety against accidental release. The device itself may be bolted or welded to the top of vessels and/or containers, and used therewith for the lifting and/or lowering of those vessels and/or containers. These and many other advantages will become apparent following the detailed description of the preferred embodiments.

A feature of the present invention includes having a key member associated with the load pin that is used to lock the load pin in place. Another feature is the use of a plurality of guide members that have a passageway therein for placement of the load pin. Yet another includes forming a fulcrum point on a guide member. Another feature includes having a guide bar included with the load pin, with the guide bar cooperating with the channels contained on the guide members.

BRIEF DESCRIPTION OF THE PREFERRED EMBODIMENTS

DESCRIPTION OF THE PREFERRED EMBODIMENTS

Figure 1A:
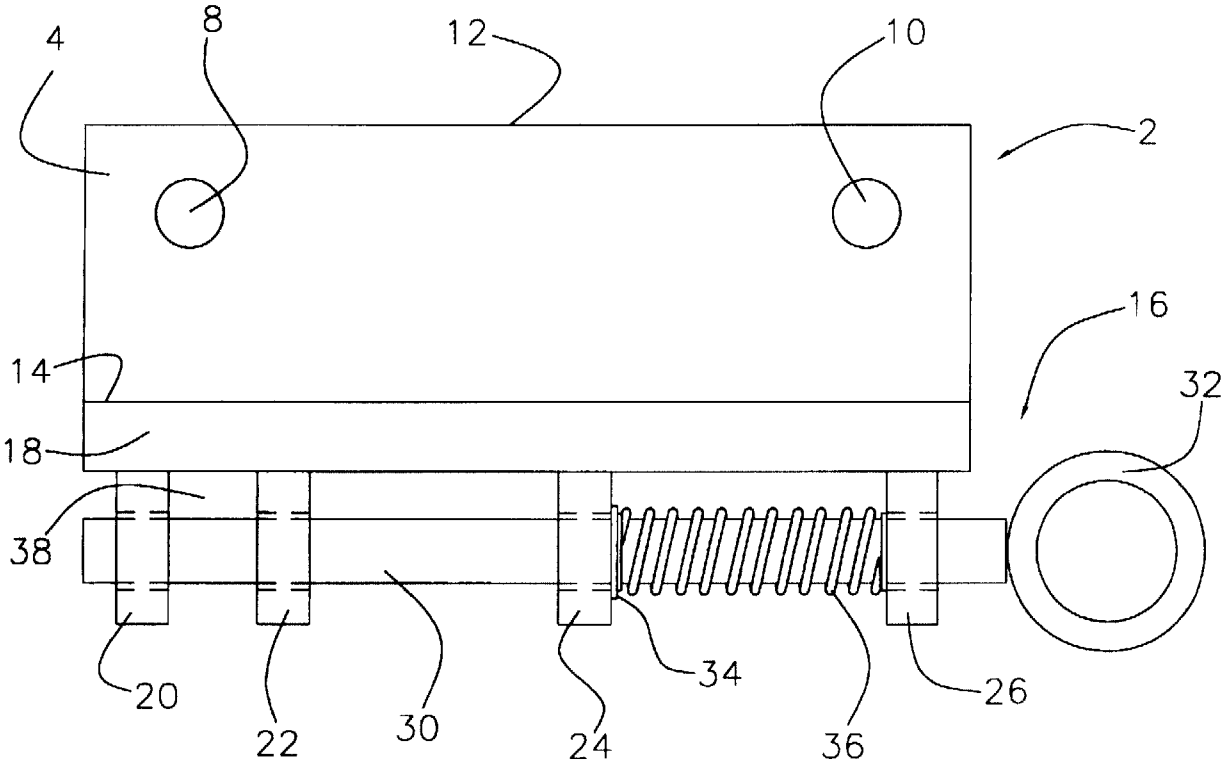
FIG. 1A is a front elevation view of the releasing apparatus of the present invention.
Figure 1B:
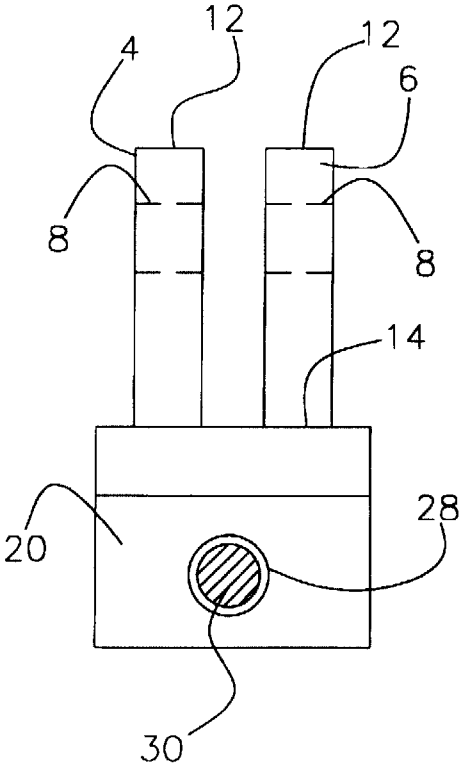
FIG. 1B is a side elevation view of the apparatus of FIG. 1.

Referring to FIG. 1A, a front elevation view of the releasing apparatus 2 of the present invention is illustrated. The apparatus 2 will contain a first plate 4 and a second plate 6, with the plates 4, 6 having contained therein openings 8 and 10 for placements of a securing means (not shown) such as a bolt. As depicted, the plates 4 and 6 are rectangular with an upper side 12 and an underside 14.

The underside 14 has attached thereto the latch means 16 for latching and unlatching a sling means (see FIG. 2) that is operatively associated with the load being transported. As seen in FIG. 1A, the latch means has a generally rectangular plate 18 that will have extending laterally therefrom a first member 20, a second member 22, a third member 24, and a fourth member 26. The members 20–26 will have formed therein openings 28.

A rod 30 is positioned through the openings 28, as shown in the various figures. The rod 30 has a first end 32 that in the preferred embodiment is a circular handle member. The rod 30 will have attached thereto a washer 34 that in turn has abutting a biasing means 36 for biasing the rod into the closed positioned as seen in FIG. 1A. In the preferred embodiment, the biasing means 36 is a conical spring 36 that bias the rod 30 closed. Thus, with the biasing means 36 slidably disposed about the rod 30, the latch means 16 is positive acting i.e. the operator must exert a pulling force on the handle member 32 in order to pull the rod 30 into an open position (also referred to as the released position).

As shown in FIG. 1A, a chamber 38 is formed relative to the rod 30 and members 20, 22 while the rod 30 is in the closed position. It should be noted that the members 24 have been added to the preferred embodiments so that the rod 30 better aligns with the openings 28 as well as for structural support. As will be more fully set out hereinafter, the sling means may be inserted into the chamber 38. Thus, when the rod is pulled via handle end 32, the operator may insert the sling into the chamber 38, or alternatively, the operator may withdraw the sling from the chamber 38.

Figure 2:
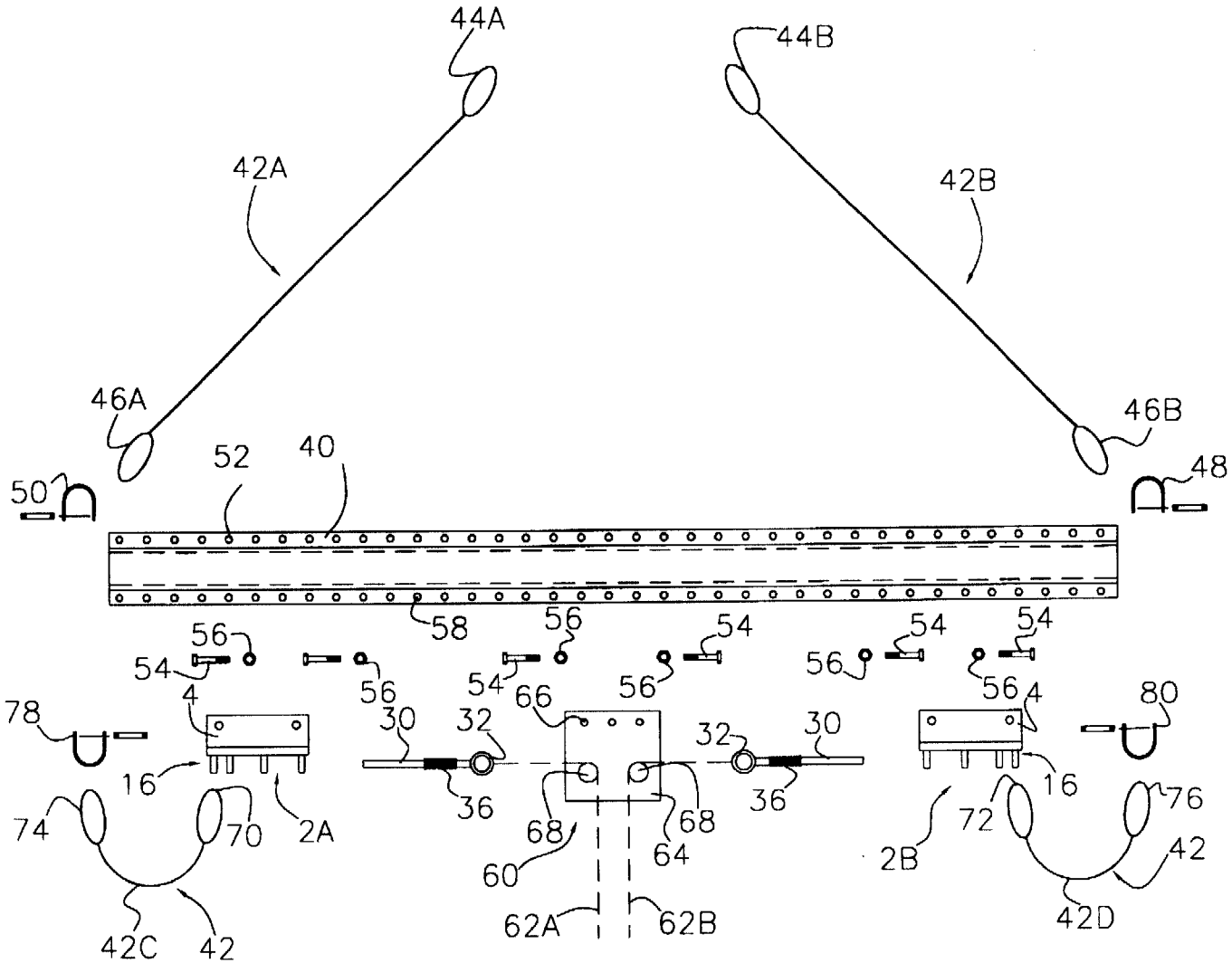
FIG. 2 is a front elevation view of the apparatus of the present invention with a spreader bar and sling means.

Referring now FIG. 2, a front elevation view of the apparatus 2 of the present invention with a spreader bar 40 and sling means 42 is illustrated. It should be noted that the system of FIG. 2 is one system by which the apparatus 2 of the present invention may be utilized. The device 2 itself may be bolted or welded to the top of vessels and/or containers, and used therewith for the lifting and/or lowering of those vessels and/or containers. Further, it should also be noted that throughout the application, like numbers in the various figures refer to like components.

As will be understood by those of ordinary skill in the art, the sling means 42 contains individual sling means 42A and 42B, with sling means 42A having a first end 44A and sling means 42B having a first end 44B, with the ends 44A and 44B that may be attached for instance, to a means for lifting a load such as a crane (not shown). The second end 46A and 46B of the sling means 42A and 42B will be attached to the spreader bar 40 via shackles 48 and 50. The shackles 48, 50 fit through the upper series of apertures 52 contained on said spreader bar 40.

As depicted in FIG. 2, there are two (2) apparatus (designated as 2A and 2B) that are attached to the spreader bar 40. The apparatus 2A and 2B are attached via the bolts 54 and nuts 56, with the bolts 54 being inserted into the lower series of apertures 58 and thereafter screwed into place via nuts 56.

FIG. 2 also illustrates the activating means 60 for activating the latch means 16. The activating means will include an activating line 62A and 62B, with the activating line 62A and 62B having one end attached to the handle 32. Thus, each latch means 16 is independently activated. The activating means 60 will include an orienting plate 64 which will have contained therein apertures 66 for placement of a nut 56 and bolt 54 so that the orienting plate 64 will be attached to the spreader bar 40. The orienting plate 64 will also contain the pulley members 68, with the pulley members 68 being mounted on the orienting plate 64 such that the pulleys 68 are rotatable.

Thus, as the operator exerts a pulling force on the activating line 62A and/or 62B, the positive acting latch means 16 will cause the rod 30 to move so that the chamber 38 is opened. The pulleys 68 also allow for the activating line 62A, 62B to be in a horizontal plane relative to the handle end 32 so that the pull force is in the plane of the rod 30. Note that in this embodiment, the two separate activating lines 62A, 62B are independent of each other.

Also shown in FIG. 2 are the sling means 42C and 42D. The end 70 and end 72 of the slings 42C and 42D, respectfully, will cooperate and fit into the previously described chamber 38. The opposite ends of the slings 42C, 42D are ends 74 and 76. The ends 74 and 76 may be attached to the actual load to be lifted such as the joist seen in FIG. 3 via the shackles 78 and 80 as is well understood by those of ordinary skill in the art.

Figure 3:
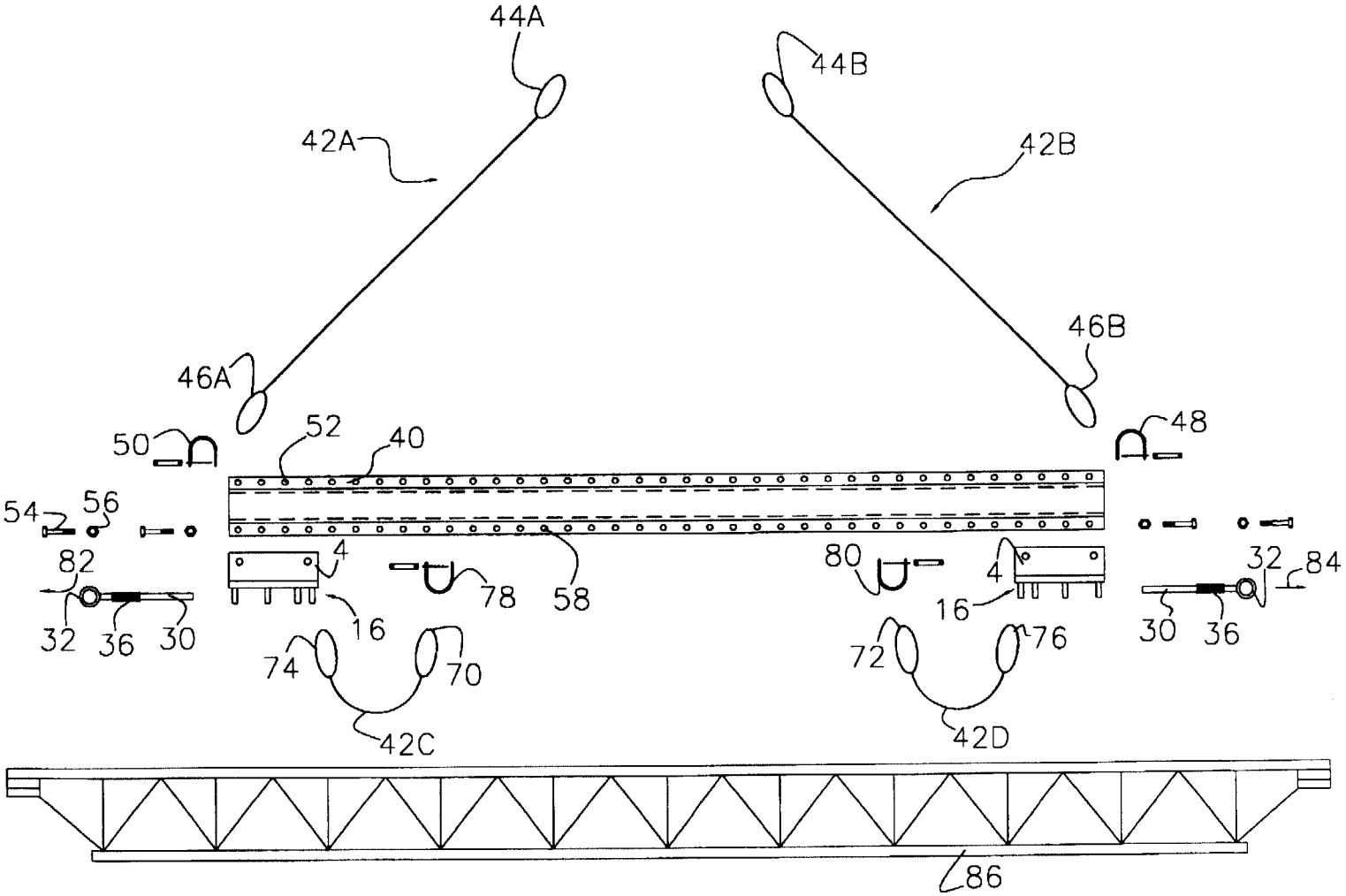
FIG. 3 is another system of the present invention along with a joist member.

Referring now to FIG. 3, a second embodiment of the system herein disclosed is shown. The embodiment shown in FIG. 3 depicts the apparatus 2 oriented in a 180 degree rotated planar position as compared to the system of FIG. 2. Thus, the handle ends 32 must be pulled from the opposite direction as noted by the arrows 82 and 84. FIG. 3 also depicts the bar joist 86 which characterizes the load to be lifted and/or moved and/or supported. The operator would utilize the slings 42C and 42D for such lifting, moving and/or supporting.

The system of FIG. 3 would require attachment of the first plate 4 with the apertures 58 of the spreader bar 40 as previously described. The ends 74 and 76 are placed into the chamber 38. This is performed by exerting a pulling force 82, 84 on the handle end 32 thereby displacing the rod 30 sufficiently to place the ends 74 and 76 into the chamber 38. The sling means 42C and 42D are then passed through the bar joist 86 (as is well understood by those of ordinary skill in the art). Thereafter, the ends 70 and 72 are attached to the spreader bar 40 via the shackles 78 and 80—with the end 70 being associated with the shackle 78, and the end 72 being associated with the shackle 80.

Figure 4:
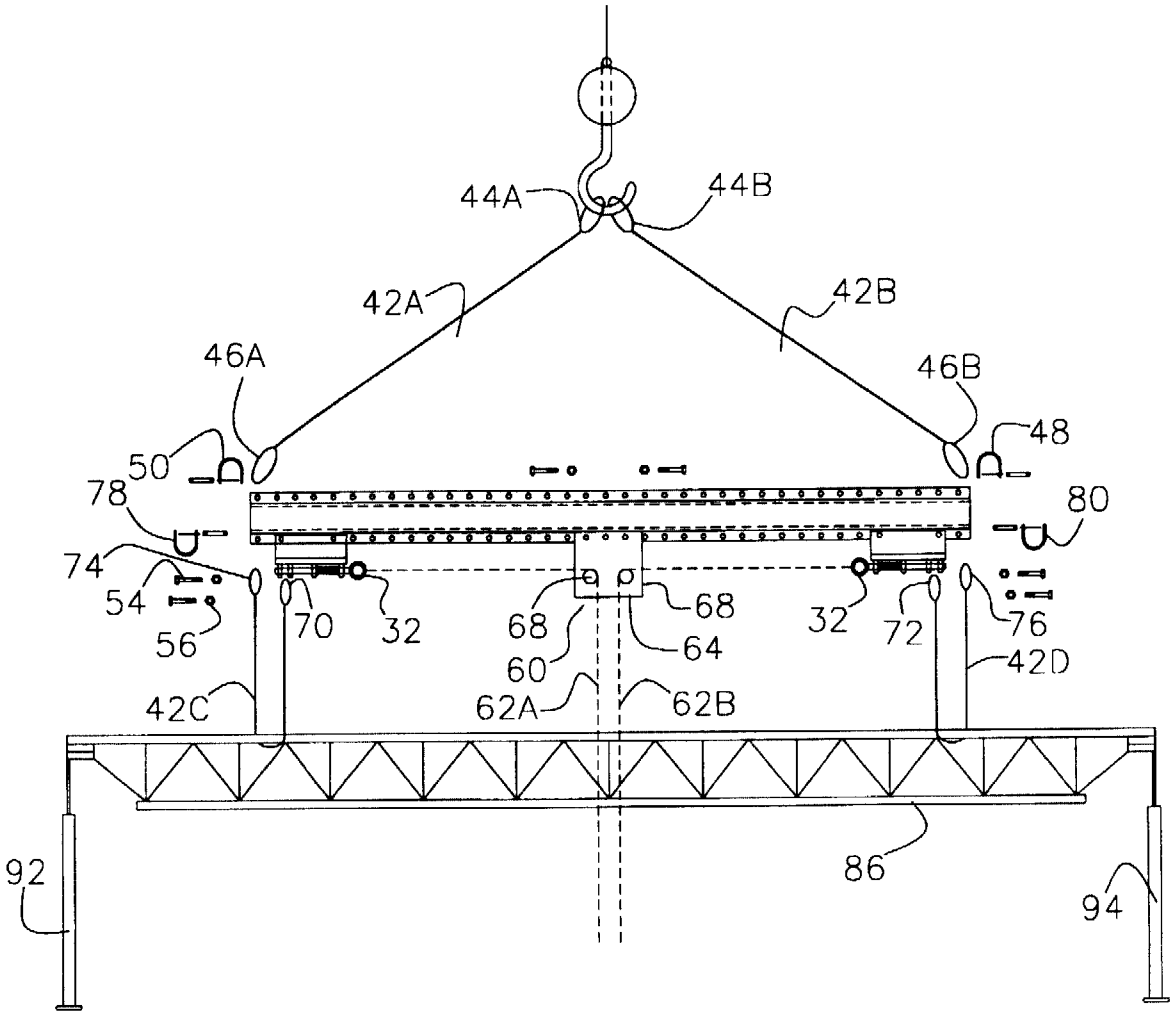
FIG. 4 is the system of FIG. 3 being positioned with a crane at a construction site.

With reference to FIG. 4, the system of the preferred embodiment of the present invention is depicted. Thus, the sling means 42A and 42B are attached at one end 44A and 44B to a crane hook 88, with the crane hook being ultimately attached to a crane line 90. The second ends 46A and 46B are attached to the spreader bar 40 via the shackles 48, 50. The apparatus 2 is also attached to the spreader bar 40 as previously described. The sling means 42C and 42D are looped about the bar joist 86. The ends 70 and 72 will be placed into the chamber 38 as previously described. The ends 74 and 76 will be attached to the spreader bar 40 via shackles 78, 80.

Also depicted in FIG. 4 are the columns 92 and 94 that will have the bar joist 86 positioned thereon. The dimensions shown are a height of approximately 20 feet and a length of 40 feet. However, these dimensions are meant to be illustrative, and the invention is applicable to dimensions both smaller and larger than those shown.

FIG. 4 is an example of the apparatus 2 being used with a spreader bar 40 and related rigging to handle a long span bar joist 86. In some cases, the bar joists are fabricated in excess of 100 feet in length. They generally are not very stable until all bracing is installed and present a problem to the erector when it is time to release the rigging. The problem is magnified when the crane operator is working in the "blind", such as the case when the crane operator can not see the rigging to be released. When using the apparatus 2 of the present invention, when the load is slacked, a pull by the operator on the activating lines 62A and 62B will cause the rod 30 to shift laterally via the activating means 60 so that the chamber 38 is opened thereby allowing the ends 70 and 72 to fall out. Thus, the rigging is released and the crane is again swinging for the next piece. While a bar joist 86 is used, the apparatus 2 is certainly applicable to use with beams, bents, vessels, etc.

The apparatus 2 can be fabricated of A-36 grade steel or molded similar to the common shackles. Further, the apparatus 2 can be designed to a varying degree of capacity to suit a wide variety of needs. An additional safety latch with a release cord can be added for added surety against an accidental release for some unknown reason.

Figure 5:
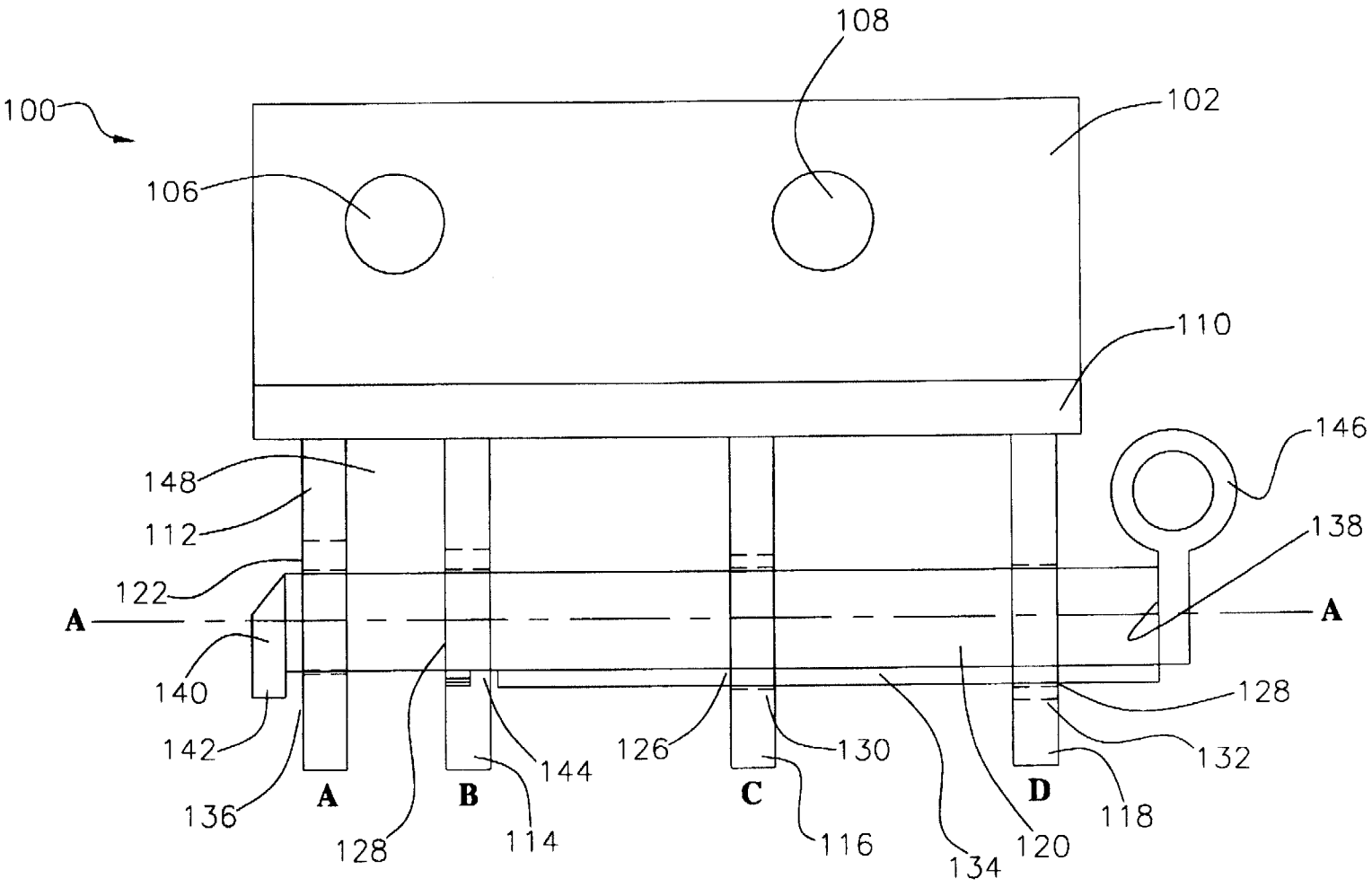
FIG. 5 is a second embodiment of the latch member in the locked position.

Referring now to FIG. 5, a second embodiment of the present invention will now be described. In this embodiment, the releasing latch 100 contains connection plates 102 and 104 that have apertures 106 and 108 therethrough for placement, for instance, of bolt means for connecting the release latch 100 to a spreader bar. The release latch 100 may be connected to other types of apparatuses. The apertures 106 and 108 are formed through the connection plates 102/104 off the lateral center due to the distribution of weight on the release latch 100.

The embodiment of FIGS. 5 through 8 depicts a latch means for latching and unlatching a load. The latch means generally include a carrier plate, a guide member, and a load pin. The latch means may also contain biasing means. The underside of connection plates 102/104 will be attached to the carrier plate 110. The carrier plate 110 is generally rectangular in shape. The carrier plate 110 will have extending therefrom a first load/guide member 112, a second load/guide member 114, a third guide member 116, and a fourth guide member 118. The guide members 112, 114, 116 and 118 will have a passage therethrough that is operatively adapted to receive the load pin 120.

The passages through the guide members include the opening 122 formed in the guide member 112, the opening 124 formed in the guide member 114, the opening 126 formed in the guide member 116, and the opening 128 formed in the guide member 118. The openings 122, 124, 126 and 128 will have a first diameter D1, a second diameter D2, a third diameter D3, and a fourth diameter D4, with the diameters being axially offset relative to the first diameter D1, second diameter D2, third diameter D3, and the fourth diameter D4. In other words, each opening would have a center point, with each center point being offset relative to the next opening in a descending order as shown in FIGS. 5, 6 and 7.

Figure 6:
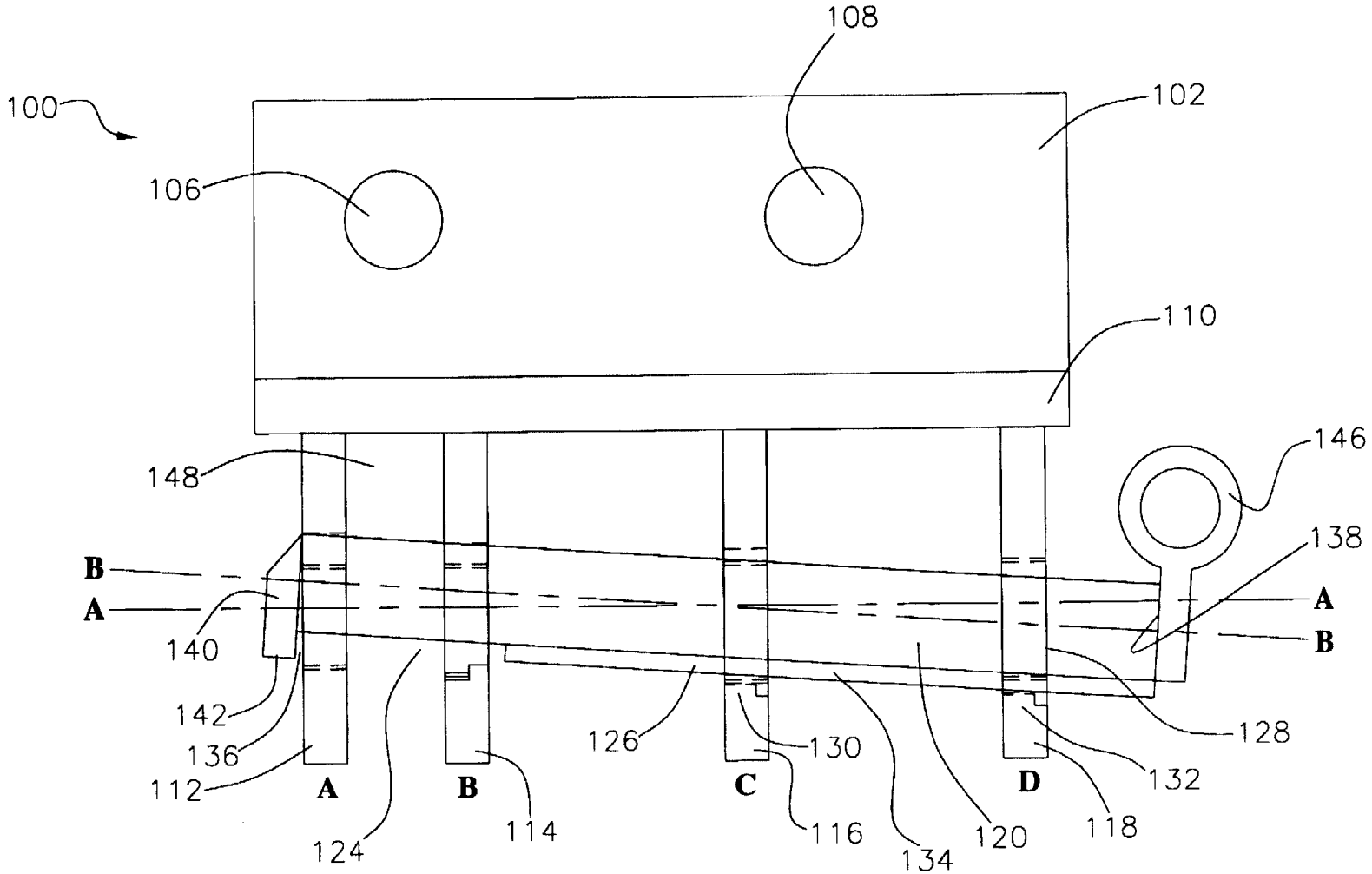
FIG. 6 is the latch member of FIG. 5 in the unlocked position.
Figure 7:
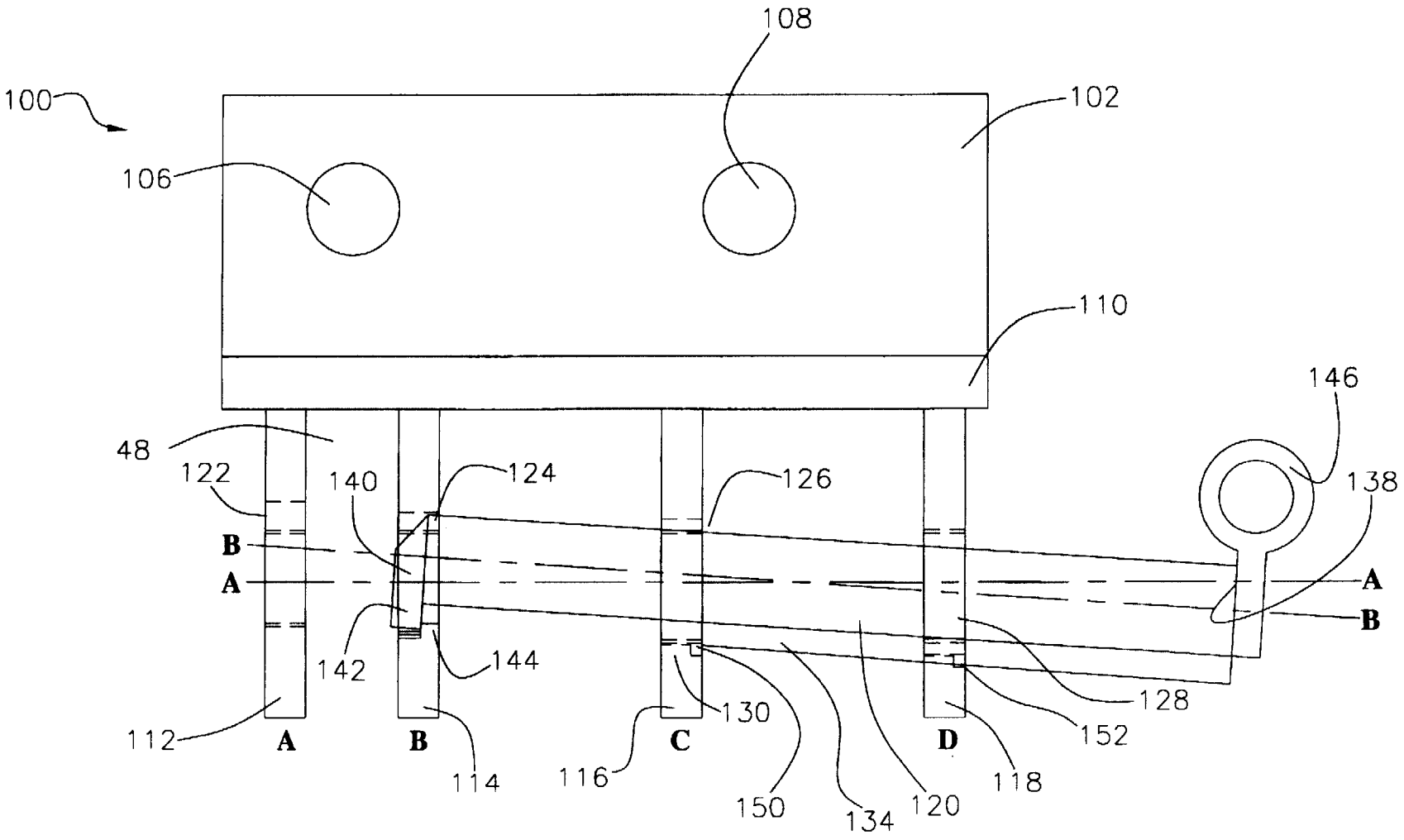
FIG. 7 is the latch member of FIG. 5 in the released position.

With the centers offset this way, the load pin 120 is allowed to pivot as seen in FIG. 6. In the preferred embodiment, the openings are oblong in shape. Further, the opening 126 in the guide member 116 has a channel 130 provided within, and the opening 128 in the guide member 118 has a channel 132. The channels 130, 132 will receive the guide pin 134, with the guide pin 134 being operatively associated with the load pin 120 as shown in FIG. 5.

In the preferred embodiment, the load pin 120 will have a first end 136 and a second end 138, with the first end 136 containing a key member 140 for engaging the release latch 100 in a locked position. As depicted in FIG. 5, the key member 140 overlaps the load pin 120, with the overlap segment represented by the numeral 142. Thus, the overlap segment 142 will engage the guide member 112 when the release latch 100 is in the locked position as seen in FIG. 5. As will be more fully explained with reference to FIG. 7, the opening 124 may contain a lip 144 that will serve as a stop for the advancement of the load pin 120 through the passages. In other embodiments, this area will be cut fully through member 114 since the lip is optional. Also included on the second end of the load pin 120 is the handle member 146. A fulcrum point located generally at the channel 130 is provided with the design herein disclosed, with the fulcrum point allowing the pivoting of the load pin 120 as seen in FIG. 7 such that the end 136 is pivoted upward and the end 138 is pivoted downward.

The release latch 100 will also include a biasing means (not shown) which is disposed about the load pin 120 between the guide members 116 and 118. Thus, the biasing means will create a positive force tending to force the load pin 120 through the passages and into the closed position. The biasing means will also act to resist movement of the load pin 120 out from the passages, i. e., resist opening of the release latch 100 as was fully explained earlier in the application.

Also depicted in FIG. 5 is the line A—A that has been drawn axially through the center of the load pin 120. As shown, the axial line A—A is essentially horizontal. Thus, with the action of the biasing means, any outward force to move the load pin to the right (open the release latch 100) will be opposed by the key 140 by engagement of the overlap 142 with the guide member 112 as well as the opposing force of the biasing means. With the load pin 120 in place, a chamber 148 is created whereby the sling member may be placed. Thus, when a downward force is exerted on the sling member (i.e. weight), the load pin is pivoted downward as seen in FIG. 5 and the release latch 100 is secure and an inadvertent release will be prevented.

Referring now to FIG. 6, the release latch 100 of FIG. 5 is illustrated in the unlocked position. It should be noted that like numbers appearing in the various figures refer to like components. Thus, the method of unlocking includes the operator slacking off weight such as positioning the load on the ground so that the sling (which had been placed in the chamber 148) is no longer exerting a downward force on the load pin. The load pin 120 would then be pivoted on the fulcrum point located at the channel 130. As seen in FIG. 6, this pivoting causes the axial center line of the load pin to be shifted from the horizontal line A—A (seen in FIG. 5) to the offset axial line B—B. In the preferred embodiment, this pitch of the former axial line A—A to the current axial line B—B is approximately 4 to 8 degrees, with the exact amount of pitch depending on the particular load design characteristics.

In the position shown in FIG. 6, the load pin 120 may be moved to the release position. As shown, the key member 140 has been lifted, and in turn the overlap 142 has been lifted, so that the key member 140 can be passed through the opening 122. It should be noted that the opening 122 must be of sufficient diameter to allow the passage of the key member 140 therethrough. Also, the center of each opening is offset relative to the previous opening in descending order. Put another way, the line B—B runs basically through the centers of openings 122, 124, 126 and 128.

The operator may begin to exert a pulling action on the handle 146 as set out in FIG. 7. In accordance with the teachings of the present invention, the operator exerts the pull force via the handle 146. The biasing means will compress once the force of the spring is overcome. Continued pulling on the handle 146 will allow the key member 140 through the opening 122 and partially through opening 124. In one embodiment, the guide members 116 and 118 may have contained within the openings 126 and 128 roller bearings 150 and 152 to aid in the movement of the load pin 120 therethrough. The continued movement of the load pin 120 is along the line B—B, in the direction of the force arrow labeled "Action". In the embodiment of FIG. 5, further movement will cause the lip 144 to engage with the overlap 142 of the key member 140 so that further movement of the load pin 120 will be prevented.

Thereafter, the operator may then extract the sling from the chamber 148. The operator may then, for instance, prepare another load for transportation. Thus, the operator may then place the sling means within the chamber 148. In order to return the releasing latch 100 to the locked position seen in FIG. 5, the operator would allow the biasing means to urge the load pin through the openings 124 and 122. Next, the operator would pivot the load pin 120 about the fulcrum point so that the axial center line of the load pin 120 is essentially horizontal (such as line A—A). Thereafter, the load may be picked up via the sling means so that a load is encountered on the load pin in the chamber 148.

Figure 8A:
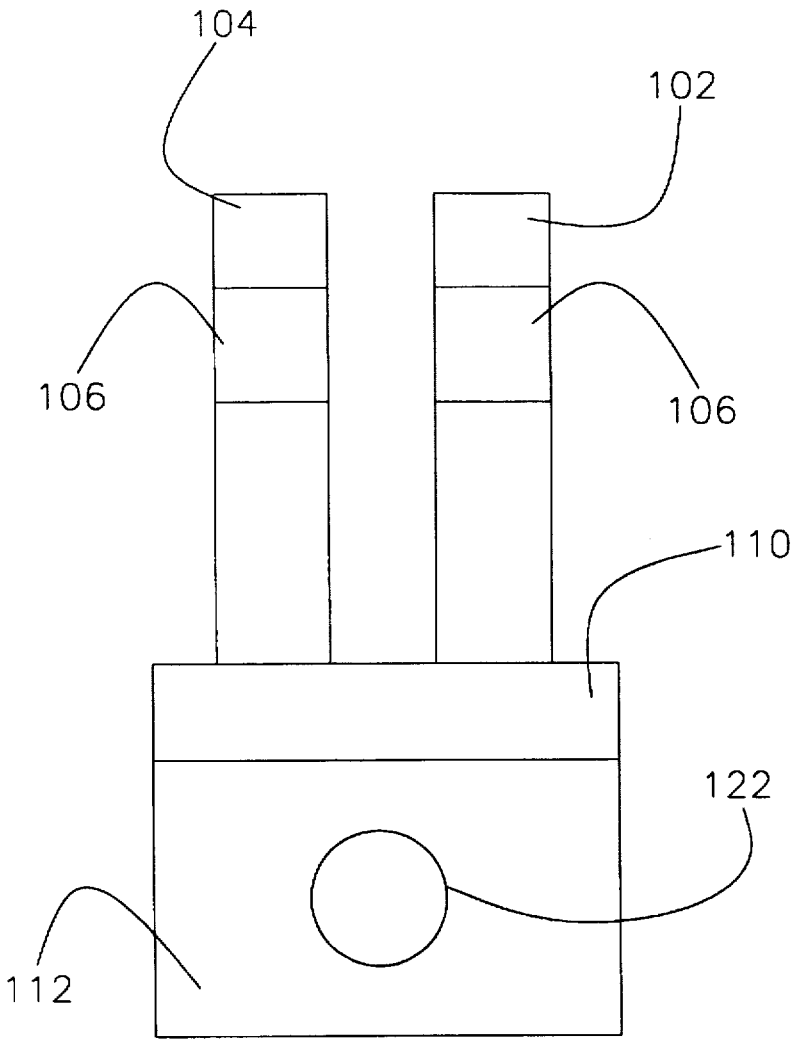
FIGS. 8A & 8B are end views of the latch member of FIG. 5.
Figure 8B:
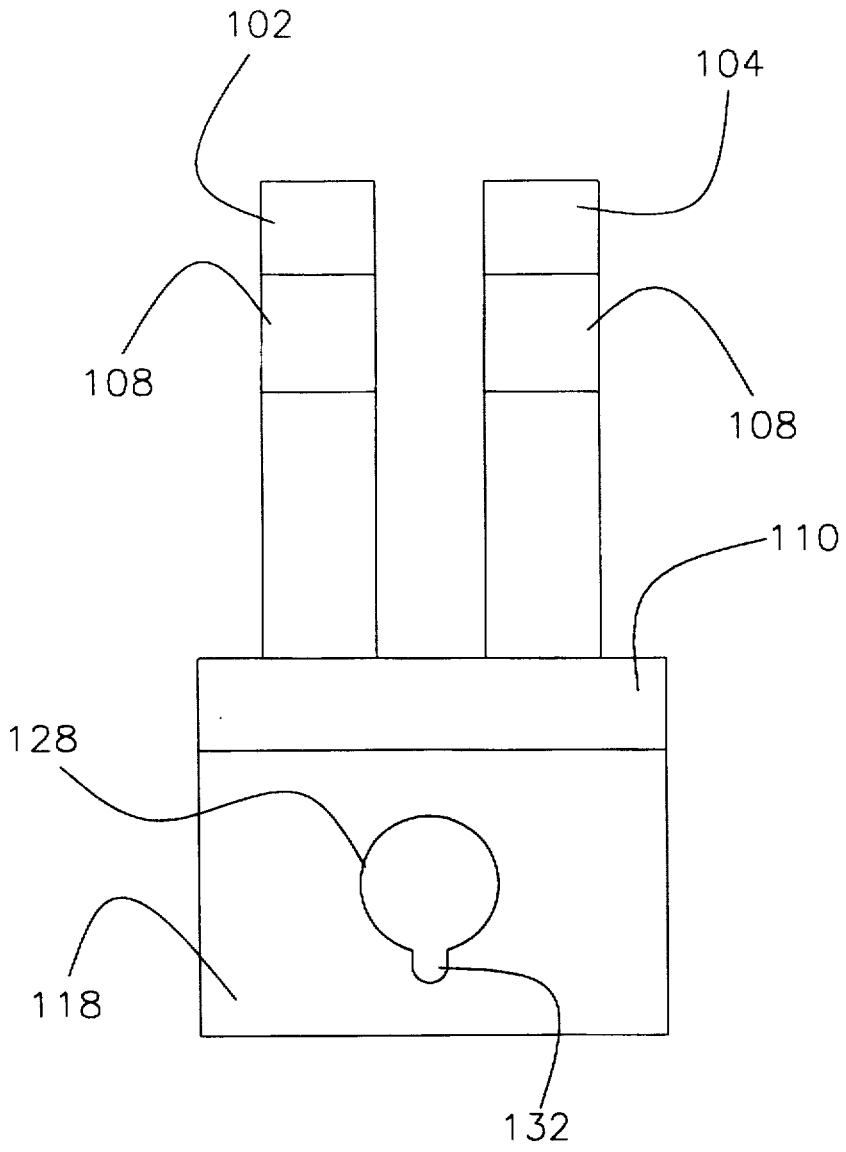

Referring now to FIGS. 8A and 8B, the end views of the latch member 100 of FIG. 5 will now be described. Thus, FIG. 8A depicts the first guide plate 112 with the oblong opening 122 therein, having generally diameter D1. FIG. 8B illustrates the fourth guide member 118 that has contained therein the oblong opening 128 having generally diameter D4. The opening 128 has provided therein the channel 132 wherein the guide pin 134 is slidably disposed. The releasing latch 100 of FIGS. 5 through 8 may be employed with the spreader, orienting plates, joist etc, previously described. It should be noted that since the act of releasing (such as described with reference to FIG. 6) will require a force acting on the center line B—B, the line of action of the opening force will also have to be offset at the same angle. This can be easily accomplished, for instance, by lowering the pulley 68 on the orienting plate 64 of the activation plate 60 and/or counterweight the load pin at or near handle 146.

The foregoing description is provided for illustrating purposes only and is not considered limiting. Numerous additions, substitutions and other modifications can be made without departing from the spirit and scope of the present invention.

I claim:

1. A latch mechanism comprising:

a connection plate having an underside portion;

latch means, attached to said connection plate, for latching a load, said latch means comprising: a carrier plate attached to said underside portion of said connection plate; a guide member operatively connected to said carrier plate, said guide member having a passage therein; a load pin having a first end and a second end, said load pin being operatively disposed within said passage member;

a key member at the first end of said load pin;

biasing means, disposed about said load pin, for biasing said load pin into engagement through said passage and wherein said guide member comprises: a first member being attached to said carrier plate; a second member being attached to said carrier plate; a third member being attached to said carrier plate; and a fourth member being attached to said carrier plate;

and wherein said first member and said second member form a chamber for insertion of a sling member therein;

and wherein said key member is attached with said first member so that said load pin engages said first member and wherein said passage comprises a first opening having a first diameter formed within said first member, a second opening having a second diameter formed within said second member, a third opening having a third diameter formed within said third member, a fourth opening having a fourth diameter formed within said fourth member; and wherein said first diameter, said second diameter and said third diameter, and said fourth diameter each have a center and said centers are axially offset relative to each other.

2. The latch mechanism of claim 1 further comprising:

a guide pin operatively associated with said load pin;

a first channel formed in said third opening and formed to slidably receive said guide pin;

a second channel formed in said fourth opening and formed to slidably receive said guide pin;

and wherein a fulcrum point for said load pin is formed on said third member.

3. The latch mechanism of claim 2 further comprising:

a lip member formed in said second opening to engage said key member within said second opening.

4. The latch mechanism of claim 2 further comprising;

a first roller bearing member operatively positioned within said first channel; and, a second roller bearing member operatively positioned within said second channel.

5. The latch mechanism of claim 2 further comprising:

a load pin handle being associated with said load pin and adapted to receive an activation line for activating said load pin.

6. An apparatus for releasing an attached load, the apparatus comprising:

sling means for attaching the load;

a connection plate having an underside face;

a latch member, connected with said underside face, for latching and unlatching the sling means from the load and wherein said latch member comprises: a carrier plate attachd to said underside portion of said connection plate; a guide member operatively connected to said body plate, said guide member having a passage therethrough; a load pin having a first end and a second end, said load pin being operatively disposed within said passage;

a key means, operatively attached with said latch member for engaging said latch member in a locked position; and wherein said key mean is at the first end of said load pin in order to engage said guide member and, wherein said guide member comprises; a first member being attached to said carrier plate; a second member being attached to said carrier plate; a third member being attached to said carrier plate; and a fourth member being attached to said carrier plate; and wherein said member and said second member form a chamber for insertion of a sling member therein; and wherein said key means is connected with said first member so that said load pinlocks onto said first member;

biasing means, disposed about said load pin, for biasing said load pin into engagement through said passage;

an activating line attached to said latch member;

activating means, operatively connected to said activating line, for activating said latch member; and, a spreader bar, with said spreader bar having a first end and a second end, and wherein said plate is selectively attached to said first end of said spreader bar.

7. The apparatus of claim 6 further comprising:

a guide pin operatively connected with said load pin;

a first channel formed in a third opening and formed to slidably receive said guide pin;

a second channel formed in a fourth opening and formed to slidably receive said guide pin;

and wherein a fulcrum point is formed on said third member.

8. The apparatus of claim 6 wherein said first member has an first opening having a first diameter, said second member has a second opening having a second diameter, said third member has a third opening having a third diameter, and said fourth member has a fourth opening having a fourth diameter;

and wherein said first diameter, said second diameter said third diameter, and said fourth diameter each have a center and each center is axially offset relative to said first diameter, said second diameter, said third diameter, and said fourth diameter.

9. The apparatus of claim 8 further comprising:

a lip member formed in said second opening to engage said key means.

10. A method of carrying a load with a releasing latch, said releasing latch including: sling means for attaching the load; a connection plate having an underside face; a carrier plate attached to said underside face of said connection plate; a guide member operatively connected to said carrier plate, said guide member having a passage therethrough; a load pin having a first end and a second end, said load pin being operatively disposed within said passage and forming a closed chamber therein; a key means, operatively connected with said guide member, for engaging said guide member in a locked position; and wherein the method includes:

carrying the load so that a downward force is exerted via the sling means in the closed chamber;

slackening the load on a foundation so that the downward force is no longer applied to the sling means in the closed chamber;

providing a fulcrum point with said guide member;

pivoting said load pin on fulcrum point created in said guide member;

urging said load pin through said passage in a first direction so that an open chamber is created;

releasing said sling means from said open chamber.

11. The method of claim 10 further comprising:

placing said sling means within said opened chamber;

urging said load pin through said passage in a second direction so that said closed chamber is created;

pivoting said load pin on said fulcrum point so that said key means engages said guide member;

lifting said load from the foundation so that a downward force is exerted via the sling means in the closed chamber so that the load is carried.

* * * * *